US010465572B2

(12) United States Patent
Cecur et al.

(10) Patent No.: US 10,465,572 B2
(45) Date of Patent: Nov. 5, 2019

(54) ACTUATION APPARATUS FOR VARIABLE VALVE DRIVE

(71) Applicant: EATON INTELLIGENT POWER LIMITED, Dublin (IE)

(72) Inventors: Majo Cecur, Rivarolo Canavese (IT); Lubos Tomiska, Roztoky (CZ)

(73) Assignee: EATON INTELLIGENT POWER LIMITED, Dublin (IE)

( * ) Notice: Subject to any disclaimer, the term of this patent is extended or adjusted under 35 U.S.C. 154(b) by 50 days.

(21) Appl. No.: 15/766,836

(22) PCT Filed: Oct. 7, 2016

(86) PCT No.: PCT/EP2016/074099

§ 371 (c)(1),
(2) Date: Apr. 9, 2018

(87) PCT Pub. No.: WO2017/060490

PCT Pub. Date: Apr. 13, 2017

(65) Prior Publication Data

US 2019/0072011 A1 Mar. 7, 2019

(30) Foreign Application Priority Data

Oct. 7, 2015 (GB) ..... 1517728
Dec. 18, 2015 (GB) ..... 1522386

(51) Int. Cl.
*F01L 13/00* (2006.01)
*F01L 1/46* (2006.01)
(Continued)

(52) U.S. Cl.
CPC ..... *F01L 13/0036* (2013.01); *F01L 1/053* (2013.01); *F01L 1/08* (2013.01); *F01L 1/18* (2013.01);
(Continued)

(58) Field of Classification Search
CPC ... F01L 2001/186; F01L 1/46; F01L 13/0036; F01L 13/0047; F01L 2013/101;
(Continued)

(56) References Cited

U.S. PATENT DOCUMENTS 4,768,475 A * 9/1988 Ikemura ..... F01L 1/181 123/90.16
5,024,191 A * 6/1991 Nagahiro ..... F01L 1/267 123/198 D
(Continued)

FOREIGN PATENT DOCUMENTS

DE 102013202068 A1 8/2014
WO WO-2013171392 A1 * 11/2013 ..... F01L 1/181
WO WO 2014142731 A2 9/2014

*Primary Examiner* — Jorge L Leon, Jr.
(74) *Attorney, Agent, or Firm* — Leydig, Voit & Mayer, Ltd.

(57) ABSTRACT

An actuator for actuating valve-lift modes of a valve train assembly of an internal combustion engine. The valve train assembly is capable of being switched between a first valve-lift mode and a second valve-lift mode. The actuator includes a first body and a second body. The second body is mounted for reciprocal movement with respect to the first body between a first position to cause the first valve-lift mode and a second position to cause the second valve-lift mode. The actuator includes a third body supported by the second body, the third body for moving a first component of the valve train assembly to cause the second valve-lift mode. The third body is moveable relative to the second body. The actuator includes a first biaser for biasing the third body away from the second body towards the first component of the valve train assembly.

27 Claims, 11 Drawing Sheets

(51) Int. Cl.
*F01L 1/18* (2006.01)
*F01L 1/08* (2006.01)
*F01L 1/053* (2006.01)

(52) U.S. Cl.
CPC ..... *F01L 1/185* (2013.01); *F01L 1/46* (2013.01); *F01L 13/00* (2013.01); *F01L 13/0005* (2013.01); *F01L 2001/186* (2013.01); *F01L 2013/105* (2013.01); *F01L 2101/00* (2013.01); *F01L 2800/10* (2013.01)

(58) Field of Classification Search
CPC ..... F01L 2105/00; F01L 2800/10; F01L 2800/19; F01L 2820/031
USPC ..... 123/90.16, 90.17, 90.2, 90.27, 90.41, 123/90.44
See application file for complete search history.

(56) References Cited

U.S. PATENT DOCUMENTS

| | | | | | |
|---|---|---|---|---|---|
| 5,680,835 | A * | 10/1997 | Ruffing | F01L 1/2411 | 123/193.3 |
| 5,690,066 | A * | 11/1997 | Hampton | F01L 1/185 | 123/198 F |
| 8,550,047 | B2 * | 10/2013 | Odell | F01L 1/185 | 123/90.16 |
| 2007/0215080 | A1 | 9/2007 | Thomas | | |
| 2011/0048819 | A1 * | 3/2011 | Takahashi | F01L 1/185 | 180/54.1 |
| 2013/0239919 | A1 | 9/2013 | Manther | | |
| 2016/0281612 | A1 * | 9/2016 | Toth | F01L 13/065 | |

* cited by examiner

ACTUATION APPARATUS FOR VARIABLE VALVE DRIVE

CROSS-REFERENCE TO PRIOR APPLICATIONS

This application is a U.S. National Phase application under 35 U.S.C. § 371 of International Application No. PCT/EP2016/074099, filed on Oct. 7, 2016, and claims benefit to British Patent Application No. GB 1517728.0, filed on Oct. 7, 2015, and British Patent Application No. GB 1522386.0, filed Dec. 18, 2015. The International Application was published in English on Apr. 13, 2017 as WO 2017/060490 under PCT Article 21(2).

FIELD

The present invention relates to actuation, and more specifically actuation of valve-lift modes in a valve train assembly of an internal combustion engine.

BACKGROUND

With more demanding legislation for Internal Combustion (IC) engines more complex valve train assemblies with different valve-lift functions are required. For diesel engines, one of the required functions is an internal Exhaust Gas Recirculation (iEGR). The iEGR function could be achieved with different types of valve train with different complexity and different integration cost. For example, a valve train may include Switchable Rocker Arm. Switchable Rocker Arms with external actuation of latching pins (applied to both or just one exhaust position of each cylinder) can provide full iEGR functionality for standard Type II valve train system with very low integration cost. Such rocker arms may also be used for other functions, such as, for example, Early Exhaust Valve Opening (EEVO), or the like.

Switchable rocker arms for control of valve actuation by alternating between at least two or more modes of operation (e.g. valve-lift modes) are known. Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used to switch between the two modes of operation.

In some switchable rocker arms the latch pin is actuated internally, that is, it is actuated by a mechanism internal to the valve train assembly of which the rocker arm is part. Although internal actuation mechanisms can save overall space, such internal actuation mechanisms typically require modification of one or more components of the valve train, which can be expensive and complex.

SUMMARY

In an embodiment, the present invention provides an actuator for actuating valve-lift modes of a valve train assembly of an internal combustion engine. The valve train assembly is capable of being switched between a first valve-lift mode and a second valve-lift mode. The actuator includes a first body and a second body. The second body is mounted for reciprocal movement with respect to the first body between a first position to cause the first valve-lift mode and a second position to cause the second valve-lift mode. The actuator includes a third body supported by the second body, the third body for moving a first component of the valve train assembly to cause the second valve-lift mode. The third body is moveable relative to the second body. The actuator includes a first biaser for biasing the third body away from the second body towards the first component of the valve train assembly.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

An external actuation mechanism can be based on a leaf spring. When actuation is required, the leaf spring is controlled to rotate a certain amount so as to engage with a roller of the latch pin, and hence push the latch pin into the latched position. However, the inventors have recognized that such a leaf spring mechanism can take up a relatively large amount of space, and is relatively inflexible with respect to the position at which it can be located relative to the valve train.

Embodiments of the present invention provide improved external latch pin actuation mechanisms, and provide improved external actuation of valve lift modes in valve train assemblies capable of being switched between a first valve-lift mode and a second valve-lift mode.

According to an embodiment of the present invention, there is provided an actuator for actuating valve-lift modes of a valve train assembly of an internal combustion engine, the valve train assembly capable of being switched between a first valve-lift mode and a second valve-lift mode, the actuator comprising: a first body; a second body mounted for reciprocal movement with respect to the first body between a first position to cause the first valve-lift mode and a second position to cause the second valve-lift mode; a third body supported by the second body, the third body for moving a first component of the valve train assembly to cause the second valve-lift mode, wherein the third body is moveable relative to the second body; and a first biasing (first biaser) means for biasing the third body away from the second body towards the first component of the valve train assembly.

According to an embodiment of the present invention, there is provided a valve train assembly of an internal combustion engine, the valve train assembly capable of being switched between a first valve-lift mode and a second valve-lift mode, the valve train assembly comprising: the actuator according to the first aspect.

According to an embodiment of the present invention, there is provided an assembly for an internal combustion engine, the assembly comprising: a plurality of rocker arms each for operating a respective engine valve, each rocker arm comprising a first body, a second body and a latch pin that is moveable between a first position in which the latch pin latches the first body and the second body together and a second position in which the first body and the second body are un-latched to allow pivotal motion of the second body relative to the first body; a respective hydraulic actuator for each latch pin; and a common supply gallery connected to each of the hydraulic actuators for supplying pressurised hydraulic fluid to the hydraulic actuators.

Figure 1:
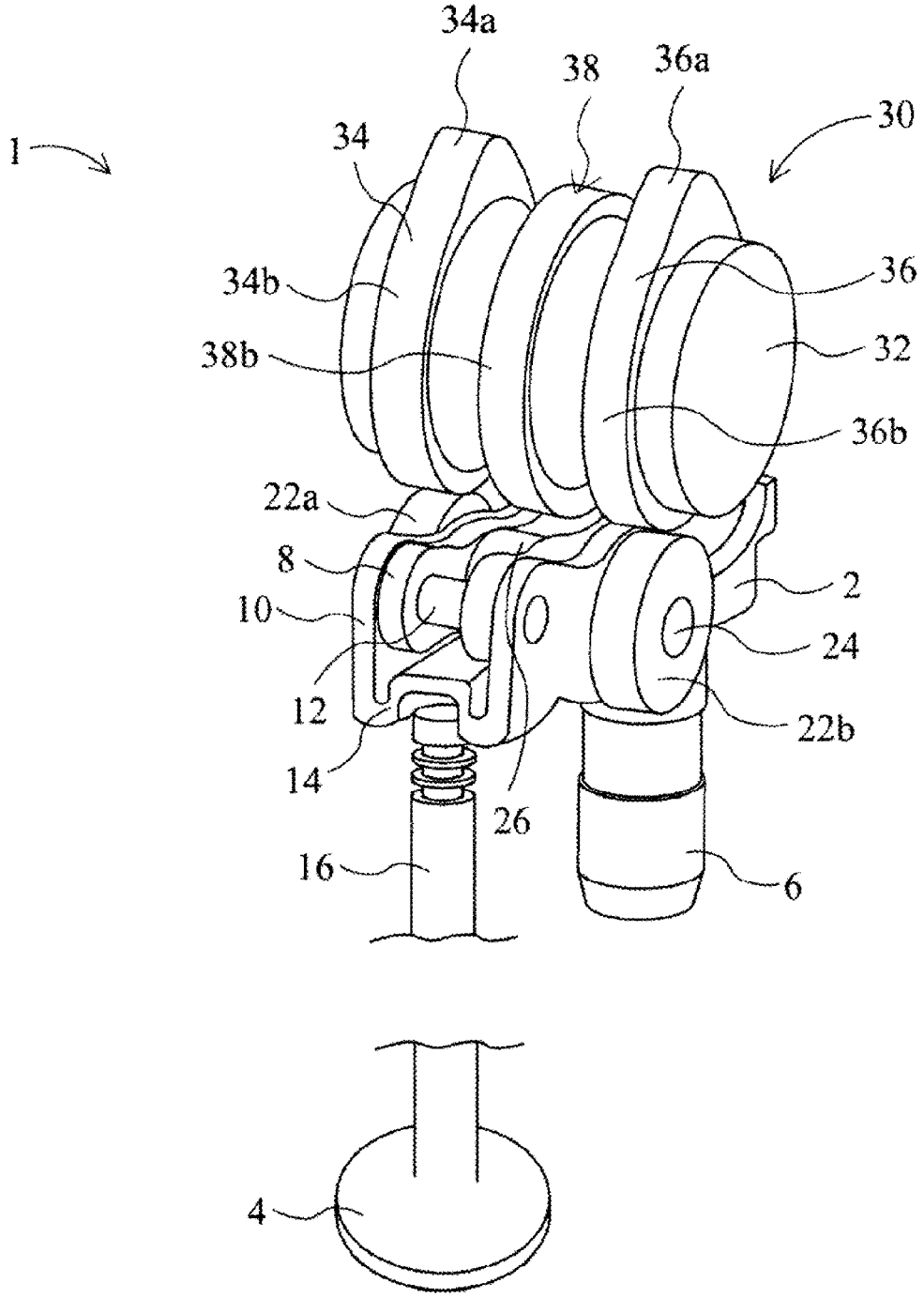
FIG. 1 illustrates a schematic perspective view of a valve train assembly including a rocker arm.
Figure 2:
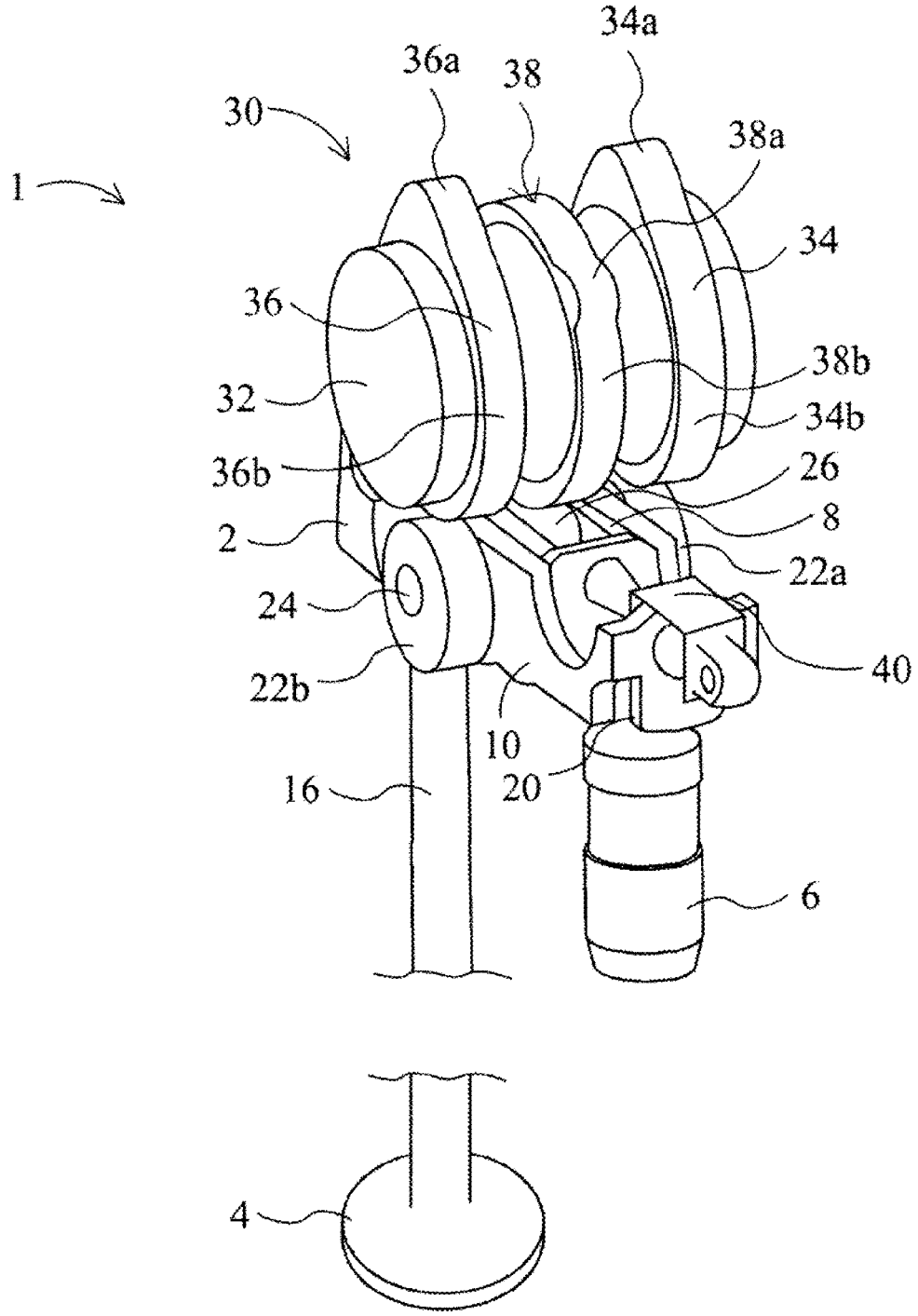
FIG. 2 illustrates another perspective view of the valve train assembly.

FIGS. 1 and 2 illustrate schematically a valve train assembly 1 comprising a rocker arm 2 according to an example. Although the example rocker arm 2 is referred to in the below, it will be appreciated that the rocker arm 2 may be any rocker arm comprising a plurality of bodies that move relative to one another, and which are latched together to provide one mode of operation (valve-lift mode) and are unlatched, and hence can move with respect to each other, to provide a second mode of operation (valve-lift mode).

Referring again to the example of FIGS. 1 and 2, a valve train assembly 1 comprises a rocker arm 2, an engine valve 4 for an internal combustion engine cylinder and a lash adjuster 6. The rocker arm 2 comprises an inner body or arm 8 and an outer body or arm 10. The inner body 8 is pivotally mounted on a shaft 12 which serves to link the inner body 8 and outer body 10 together. A first end 14 of the outer body 10 engages the stem 16 of the valve 4 and at a second end 20 the outer body 10 is mounted for pivotal movement on the lash adjustor 6 which is supported in an engine block. The lash adjuster 6, which may for example be a hydraulic lash adjuster, is used to accommodate slack between components in the valve train assembly 1. Lash adjusters are well known per se and so the lash adjuster 6 will not be described in detail.

The rocker arm 2 is provided with a pair of main lift rollers 22*a* and 22*b* rotatably mounted on an axle 24 carried by the outer body 10. One of the main lift rollers 22*a* is located on one side of the outer body 10 and the other of the main lift rollers 22*b* is located on the other side of the outer body 10. The rocker arm 2 is further provided with a secondary lift roller 26, located within the inner body 8 and rotatably mounted on an axle (not visible in FIGS. 1 and 2) carried by the inner body 8.

A three lobed camshaft 30 comprises a rotatable camshaft 32 mounted on which are first 34 and second 36 main lift cams and a secondary lift cam 38. The secondary lift cam 38 is positioned between the two main lift cams 34 and 36. The first main lift cam 34 is for engaging the first main lift roller 22*a*, the second main lift cam 36 is for engaging the second main lift roller 22*b* and the secondary lift cam 38 is for engaging the secondary lift roller 26. The first main lift cam 34 comprises a lift profile (i.e. a lobe) 34*a* and a base circle 34*b*, second main lift cam 36 comprises a lift profile 36*a* and a base circle 36*b* and the secondary lift cam 38 comprises a lift profile 38*a* and a base circle 38*b*. The lift profiles 34*a* and 36*a* are substantially of the same dimensions as each other and are angularly aligned. The lift profile 38*a* is smaller than the lift profiles 34*a* (both in terms of the height of its peak and in terms of the length of its base) and is angularly offset from them.

The rocker arm 2 is switchable between a dual lift mode which provides two operations of the valve 4 (a valve operation is an opening and corresponding closing of the valve) per engine cycle (e.g. full rotation of the cam shaft 32) and a single lift mode which provides a single operation of the valve 4 per engine cycle. In the dual lift mode, the inner body 8 and the outer body 10 are latched together by a latching arrangement 40 (see FIG. 2) and hence act as a single solid body. With this particular arrangement, the dual lift mode provides a higher main valve lift and a smaller secondary valve lift per engine cycle. The single lift mode provides just the main valve lift per engine cycle. The single lift mode is an example of a first valve-lift mode, and the dual lift mode is an example of a second valve-lift mode of the valve train assembly 1.

During engine operation in the dual lift mode, as the cam shaft 32 rotates, the first main lift cam's lift profile 34*a* engages the first main lift roller 22*a* whilst, simultaneously, the second main lift cam's lift profile 36*a* engages the second main lift roller 22*b* and together they exert a force that causes the outer body 10 to pivot about the lash adjuster 6 to lift the valve stem 16 (i.e. move it downwards in the sense of the page) against the force of a valve spring thus opening the valve 4. As the peaks of the lift profiles 34*a* and 36*a* respectively pass out of engagement with the first main lift roller 22*a* and the second main lift roller 22*b*, the valve spring begins to close the valve 4 (i.e. the valve stem 16 is moved upwards in the sense of the page). When the first main lift cam's base circle 34*b* again engages the first main lift roller 22*a* and the second main lift cam's 36 lift profile engages the second main lift roller 22*b* the valve is fully closed and the main valve lift event is complete.

As the camshaft 32 continues to rotate, then, the secondary lift cam's lift profile 38*a* engages the secondary lift roller 26 exerting a force on the inner body 8 which force, as the inner body 8 and the outer body 10 are latched together, is transmitted to the outer body 10 causing the outer body 10 to pivot about the lash adjuster 6 to lift the valve stem 16 against the force of a valve spring thus opening the valve 4 a second time during the engine cycle. As the peak of the lift profile 38*a* passes out of engagement with the secondary lift roller 26 the valve spring begins to close the valve 4 again. When the secondary lift cam's base circle 38*b* again engages the secondary lift roller 26 the valve 4 is fully closed and the second valve lift event for the current engine cycle is complete.

The lift profile 38*a* is shallower and narrower than are the lift profiles 34*a* and 36*a* and so consequently the second valve lift event is lower and of a shorter duration than is the first valve lift event.

In the single lift mode the inner body 8 and the outer body 10 are not latched together by the latching arrangement 40 and hence in this mode, the inner body 8 is free to pivot with respect to the outer body 10 about the shaft 12. During engine operation in the single lift mode, as the cam shaft 32 rotates, when the first main lift cam's lift profile 34*a* engages the first main lift roller 22*a* and the second main lift cam's lift profile 36*a* engages the second main lift roller 22*b*, the outer body 10 pivots about the lash adjuster 6 and, in an identical way as in the dual lift mode, a main valve lift event occurs. As the camshaft 32 continues to rotate, then, the secondary lift cam's lift profile 38*a* engages the secondary lift roller 26 exerting a force on the inner body 8. In the single lift mode, however, as the inner body 8 and the outer body 10 are not latched together, this force is not transmitted to the outer body 10 which hence does not pivot about the lash adjuster 6 and so there is no additional valve event during the engine cycle. Instead, as the secondary lift cam's lift profile 38*a* engages the secondary lift roller 26, the inner body 8 pivots with respect to the outer body 10 about the shaft 12 accommodating the motion that otherwise would be transferred to the outer body 10. A torsional lost motion spring (not shown in FIGS. 1 and 2) is provided to return the inner body 8 to its starting position relative to the outer body 10, once the peak of the lift profile 38*a* has passed out of engagement with the secondary lift roller 26.

In one embodiment, this arrangement may be used to provide switchable Internal Exhaust Gas Recirculation (IEGR) control. For example, if the valve 4 is an exhaust valve for an engine cylinder, the main valve lift acts as the main exhaust lift of an engine cycle, and the timing of the secondary valve lift may be arranged so that it occurs when an intake valve for that cylinder, controlled by a further rocker arm mounted pivotally on a further lash adjuster and which pivots in response to an intake cam mounted on the cam shaft 32, is open. The simultaneous opening of the intake and exhaust valves in this way ensures that a certain amount of exhaust gas remains in the cylinder during combustion which, as is well known, reduces NOx emissions. Switching to the single lift mode deactivates the IEGR function, which deactivation may be desirable under certain engine operating conditions. As will be appreciated by those skilled in the art, this switchable IEGR control may also be provided if the valve 4 is an intake valve with the timing of the secondary valve lift arranged to occur when an exhaust valve for that cylinder is open during the exhaust part of an engine cycle.

Figure 3:
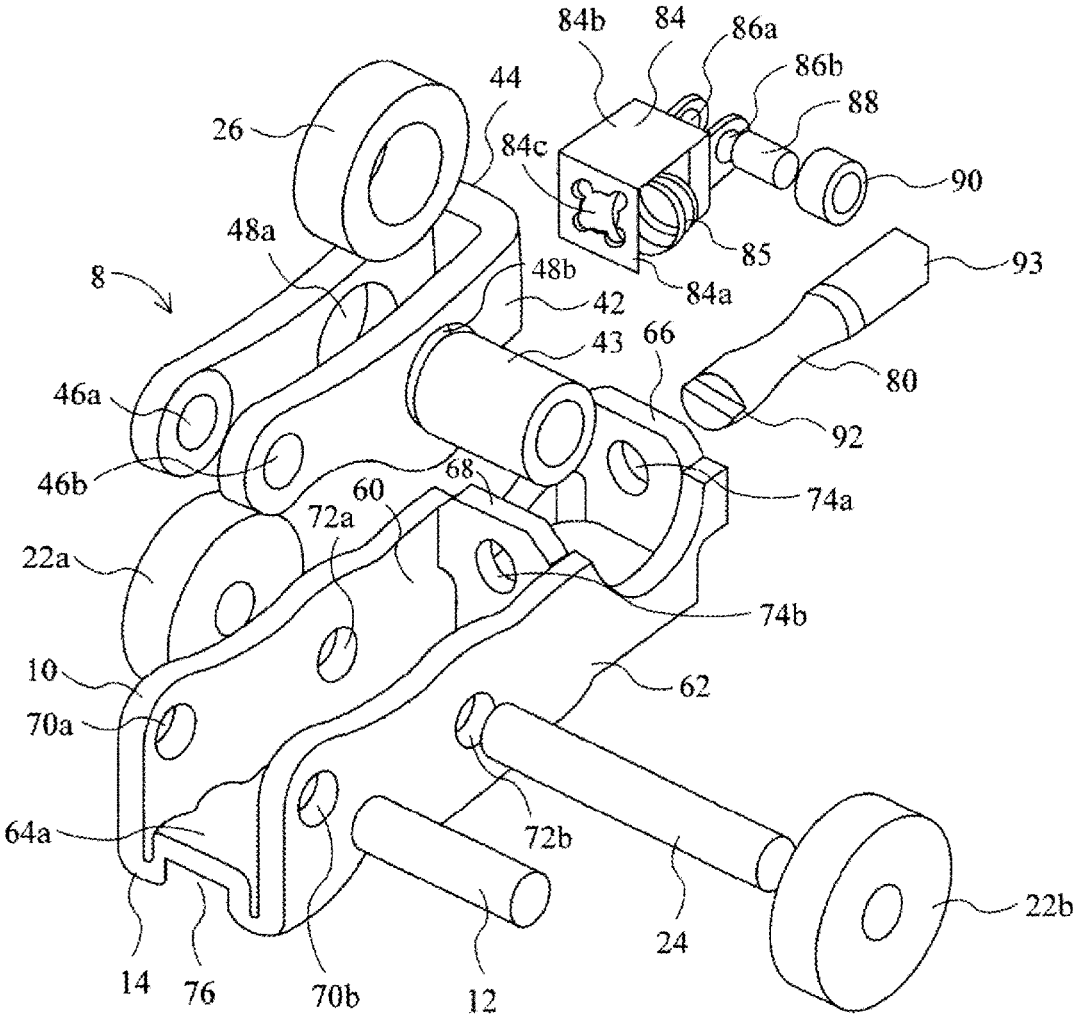
FIG. 3 is an exploded view of the rocker arm.

As is best understood from FIG. 3, the secondary lift roller 26 is mounted on a hollow inner bushing/axle 43 which is supported in the apertures 48*a* and 48*b*. The axle 24 extends through the inner bushing/axle 43 (and hence through the secondary lift roller 26) and the diameter of the axle 24 is somewhat smaller than the inner diameter of the inner bushing/axle 43 to allow movement of the assembly of the inner body 8, axle 43 and inner roller 26 relative to the outer body 10. The main lift rollers 22*a* and 22*b* are therefore arranged along a common longitudinal axis and the secondary lift roller 26 is arranged along a longitudinal axis that is slightly offset from this. This arrangement of axles and rollers ensures that the rocker arm 2 is compact and facilitates manufacturing the inner body 8 and the outer body 10 from stamped metal sheets.

As is also best seen from FIG. 3, the latching arrangement 40 comprises the latch pin 80 and an actuation member 84. The actuation member 84 comprises a sheet bent along its width to form first 84*a* and second 84*b* rectangular portions which define a right angle. The first portion 84*a* defines a hole 84*c*. The actuation member 84 further comprises a pair of winged portions extending rearwardly from the second portion 84*c* each of which defines a respective one of a pair of apertures 86*a*, 86*b* for supporting a shaft 88 on which is mounted a roller 90. The actuation member 84 straddles the end wall 66 of the outer body 10 with the second portion 84*c* slidably supported on the end wall 66 with the first portion 84*a* positioned between the end wall 66 and the inner wall 68 of the outer body 10. At one end, the latch pin 80 defines an upward facing latch surface 92.

As seen in FIGS. 4 and 5, the latch pin 80 extends through the holes 74*a* in the end wall 66 and the hole 84*c* in the actuation member 84 and its end 93 engages the wing portions of the actuation member 84.

Figure 4A:
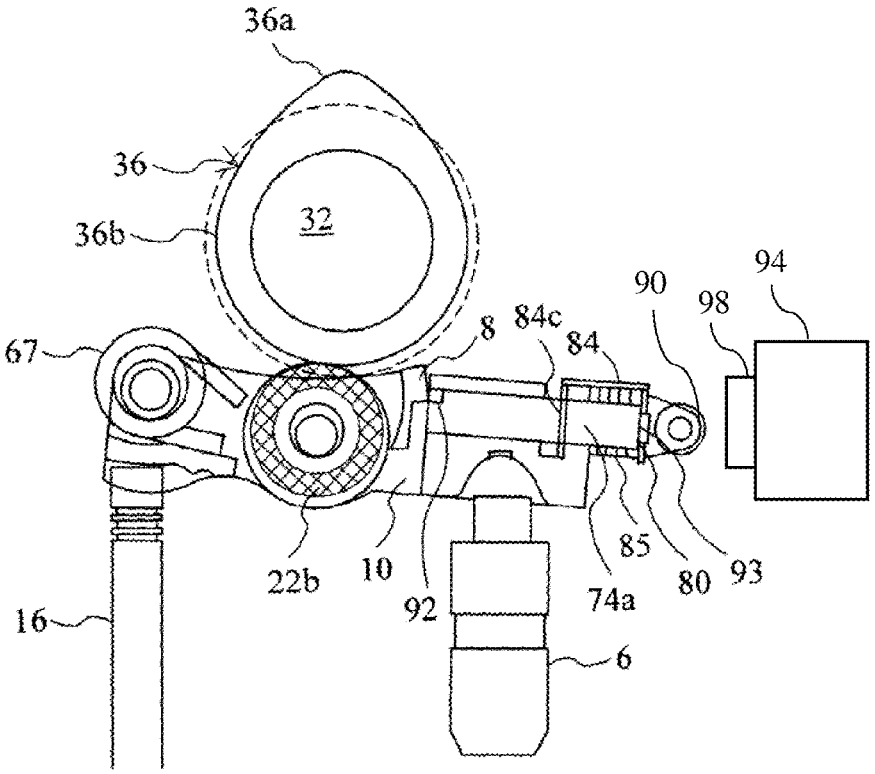
FIGS. 4*a* and 4*b* schematically illustrate the valve train assembly at two different points in engine cycle when the inner and outer bodies are latched.
Figure 4B:
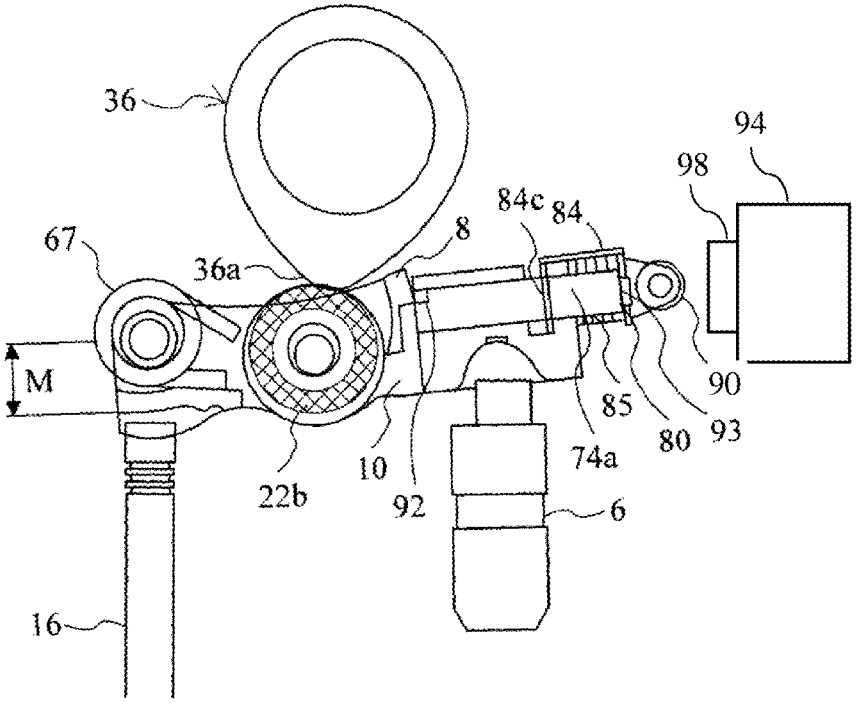

FIGS. 4*a* and 4*b* illustrate the valve train assembly 1 when the rocker arm 2 is in the single lift mode (i.e. unlatched configuration). In this configuration, the actuation member 84 and latch pin 80 are positioned so that the latch surface 92 does not extend through the hole 74*b* and so does not engage the latch contact surface 54 of the inner body 8. In this configuration, the inner body 8 is free to pivot, with respect to the outer body 10, about the shaft 12 when the secondary roller 26 engages the lift profile 38*a* and hence there is no additional valve event. It will be appreciated that the amount of movement available to the inner body 8 relative to the outer body 10 (i.e. the amount of lost motion absorbed by the inner body 8) is defined by the size difference between the diameter of the axle 24 and the inner diameter of the inner bushing/axle 43. The torsional spring 67, which is installed over the top of the valve stem 16 and is located inside the inner body 8 by the shaft 12, acts as a lost motion spring that returns the inner body 8 to its starting position with respect to the outer body 10 after it has pivoted.

Figure 5A:
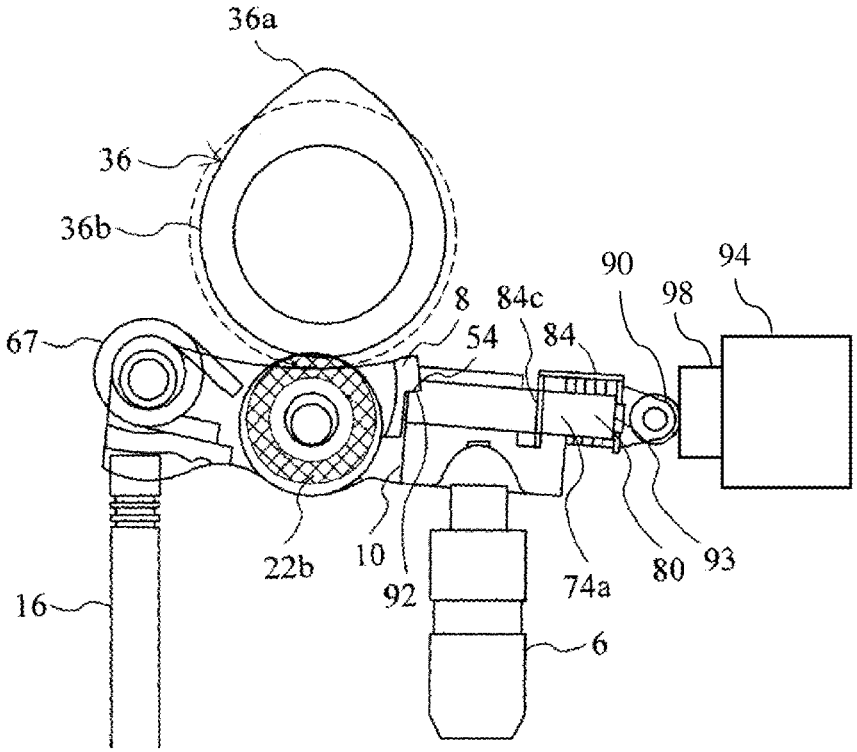
FIGS. 5*a* and 5*b* schematically illustrate the valve train assembly at two different points in engine cycle when the inner and outer bodies are un-latched.
Figure 5B:
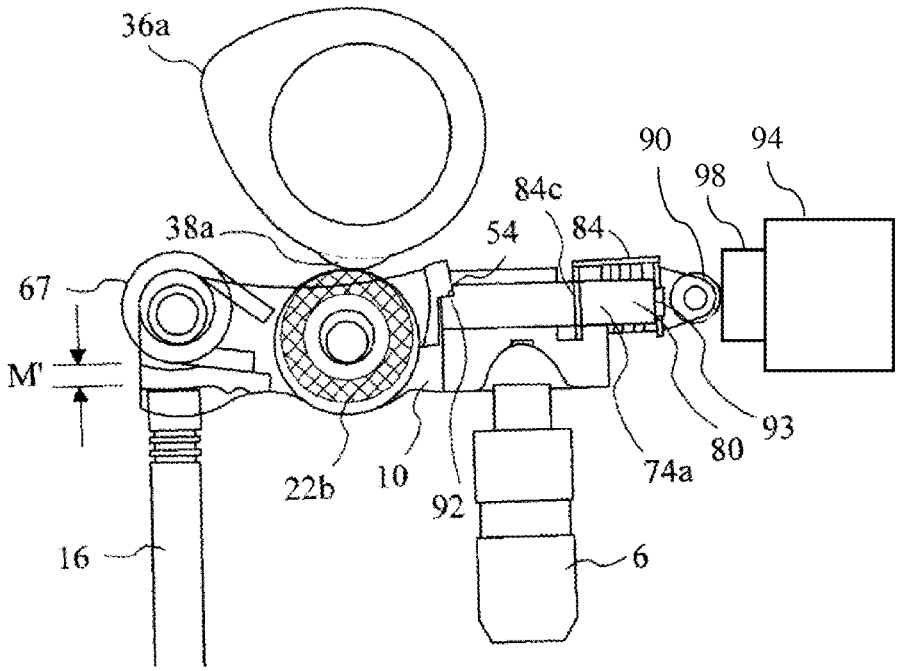

FIGS. 5*a* and 5*b* illustrate the valve train assembly 1 when the rocker arm 2 is in the dual lift mode (i.e. a latched configuration). In this configuration, the actuation member 82 and latch pin 80 are moved forward (i.e. to the left in the Figures) relative to their positions in the unlatched configuration so that the latch surface 92 does extend through the hole 74*b* so as to engage the latch contact surface 54 of the inner body 8. As explained above, in this configuration, the inner body 8 and the outer body 10 act as a solid body so that when the when the secondary roller 26 engages the lift profile 38*a* there is an additional valve event.

An actuator 94 is provided to move the latching arrangement 40 between the un-latched and latched positions. In this example, the actuator comprises an actuator piston 98. In the default unlatched configuration, the actuator piston 98 does not contact the latching arrangement 40. To enter the latched configuration, as described in more detail below, the actuator piston 98 extends to contact the roller 90 and to push the latching arrangement 40 into the latched position. A spring 85 mounted over the latch pin 80 and supported between an outer face of the end wall 66 and the winged members of the member 84 is biased to cause the latching arrangement 40 to return to its unlatched position when the actuator piston 98 retracts and no longer contacts the roller 90. (The roller 90 and/or the latching arrangement 40 are examples of a first component of the valve train assembly.)

Advantageously, when the base circle 38*b* engages the inner bushing/axle 43, the inner bushing axle 43 stops always on the axle 24 which ensures that the orientation of the various components is such that the latch pin 80 is free to move in and out of the latched and unlatched positions.

FIG. 4*a* illustrates the valve train assembly 1 when the rocker arm 2 is in the single lift mode (i.e. the un-latched configuration) at a point in an engine cycle when the main lift rollers 22*a* and 22*b* are engaging the respective base circles 34*b* and 36*b* of the first main lift cam 34 and the second main lift cam 36. At this point in the engine cycle, the valve 4 is closed. FIG. 4*b* illustrates the valve train assembly 1 when the rocker arm 2 is in the single lift mode at another point in an engine cycle when the main lift rollers 22*a* and 22*b* are engaging the respective peaks of the lift profiles 34*a* and 36*a* of the first main lift cam 34 and the second main lift cam 36. At this point in the engine cycle the valve 4 is fully open and the 'maximum lift' of the main valve event is indicated as M.

FIG. 5*a* illustrates the valve train assembly 1 when the rocker arm 2 is in the dual lift mode (i.e. the latched configuration) at a point in an engine cycle when the main lift rollers 22*a* and 22*b* are engaging the respective base circles 34*b* and 36*b* of the first main lift cam 34 and the secondary lift roller 26 is engaging the base circle 38*b* of the secondary lift cam 38. At this point in the engine cycle, the valve 4 is closed. FIG. 5*b* illustrates the valve train assembly 1 when the rocker arm 2 is in the dual lift mode at another point in an engine cycle when the main lift rollers 22*a* and 22*b* are engaging the respective base circles 34*b* and 36*b* of the first main lift cam 34 and the second main lift cam 36 and the secondary lift roller 26 is engaging the peak of the lift profile 38*a* of the secondary lift cam 38. At this point in the engine cycle the valve 4 is fully open during the additional valve event and the 'maximum lift' of the secondary valve event is indicated as M'.

Figure 6:
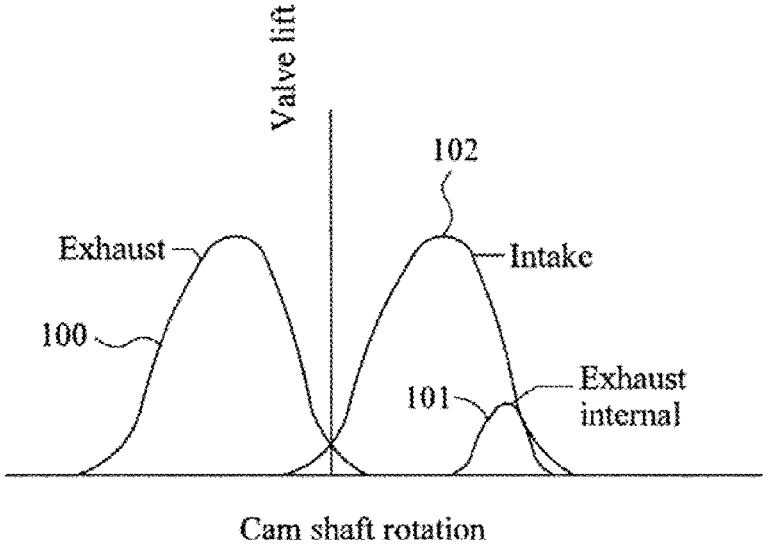
FIG. 6 illustrates a graph showing valve lift against cam shaft rotation.

FIG. 6 illustrates a graph in which the Y axis indicates valve lift and the X axis indicates rotation of the cam shaft. In the example of the valve 4 being an exhaust valve, the curve 100 represents the main lift of the exhaust valve during an engine cycle and the curve 101 represents the additional lift of the exhaust valve during the subsequent engine cycle. The curve 102 represents the lift of intake valve (not shown in the figures), during the subsequent engine cycle, operated by an intake rocker arm (again not shown in the Figures) in response to an intake cam (not shown in the Figures) mounted on the cam shaft. It can be seen that the cams are arranged so that in any given engine cycle, the additional smaller opening of the exhaust valve occurs when the intake valve is open to thereby provide a degree of internal exhaust gas recirculation.

As previously mentioned, in an alternative arrangement the valve 4 is an intake valve rather than an exhaust valve (making the rocker arm 2 an intake rocker arm) and an exhaust rocker arm operates an exhaust valve in response to an exhaust cam mounted on the cam shaft. In this alternative arrangement the cams are arranged so that in any given engine cycle, the additional smaller opening of the intake valve occurs when the exhaust valve is open to thereby provide a degree of internal exhaust gas recirculation.

Figure 7A:
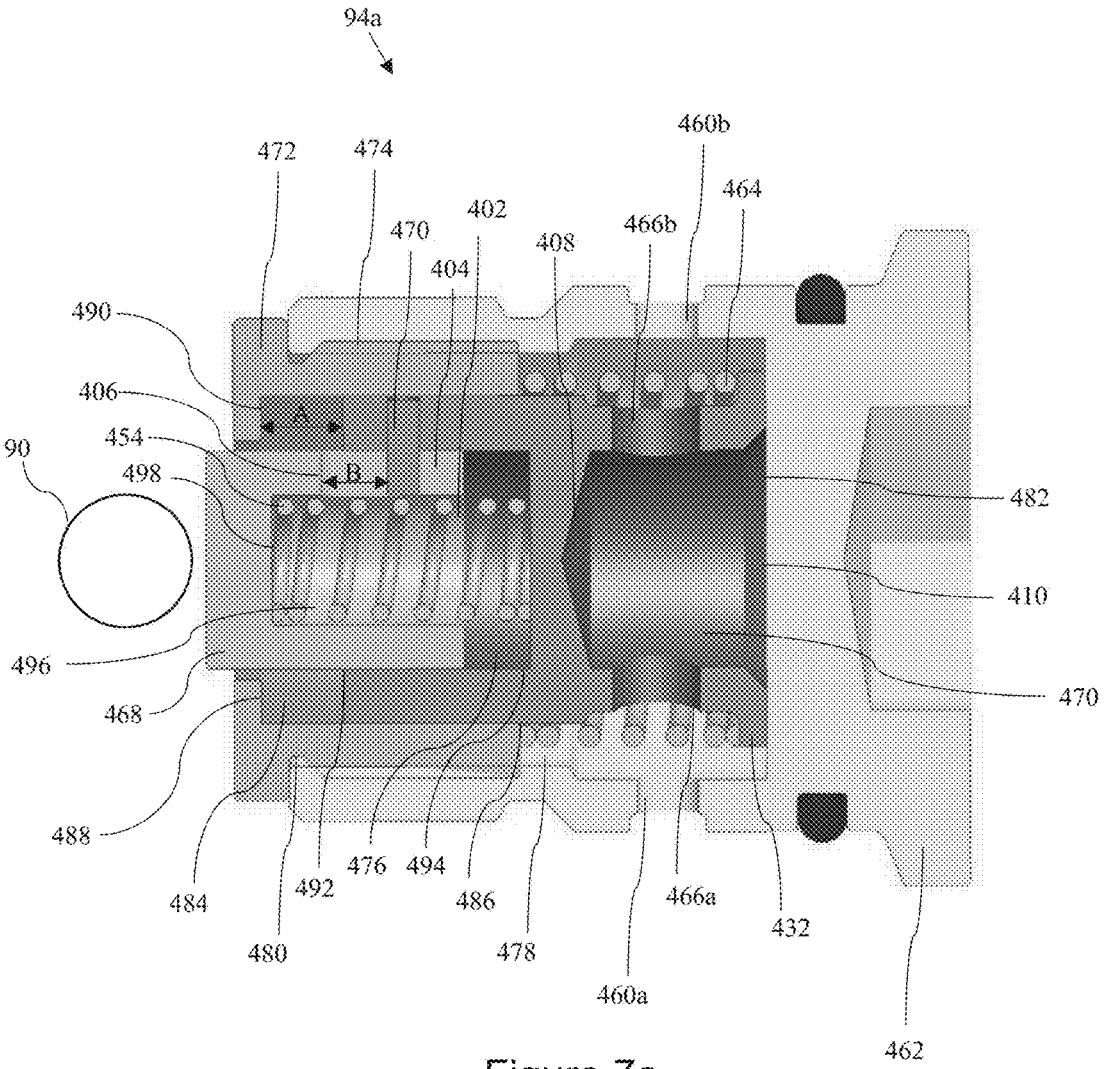
FIG. 7*a* schematically illustrates a cross section of an exemplary actuator.
Figure 7B:
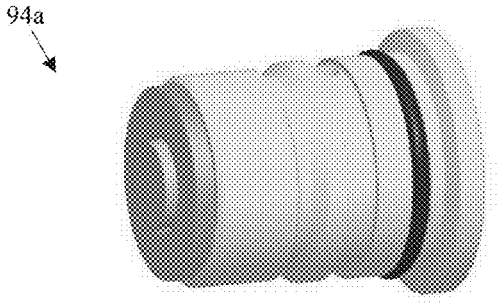
FIG. 7*b* schematically illustrates a perspective view of an exemplary actuator.

FIGS. 7 and 8 illustrate schematically an exemplary hydraulic actuator 94*a* for moving the latching arrangement 40 between the un-latched and latched positions. The hydraulic actuator 94*a* may be used, for example, as the external actuator 94 described above with reference to FIGS. 4 and 5. FIG. 7*a* illustrates schematically a cross section of the hydraulic actuator 94*a*, and FIG. 7*b* illustrates schematically a perspective view of the hydraulic actuator 94*a*.

Referring now to FIG. 7*a*, the actuator 94*a* comprises a housing 462 (an example of a first body), a main piston 432 (an example of a second body), and a compliance piston 468 (an example of a third body). The compliance piston 468 is an example of an actuator piston 98 as described above with respect to FIGS. 4 and 5. The housing 462, the main piston 432, and the compliance piston 468 are each generally cylindrical in shape, and each share a common longitudinal axis.

The housing 462 comprises a bore 478 extending from an open end 480 of the housing 462 to bore end 482 within the housing 462. A stopper 472 is received in the bore 478 of the housing 462 at the bore end 482, and extends partially within the bore 478 of the housing. The stopper 472 is fixedly connected to the housing 462, for example, by a threaded connection. The stopper 472 comprises a bore 484 extending from a first open end 486 of the stopper 472 to a second open end 488 of the stopper 472. The second open end 488 of the stopper 472 is of a smaller diameter than the first open end 486 of the stopper 472, and there is a bore step 490 formed between the two diameters. The second open end 488 of the stopper 472, and the bore step 490, are towards and slightly beyond the open end 480 of the housing 462.

The main piston 432 is partially received in the bore 484 of the stopper 472 for reciprocal sliding movement with respect to the stopper 472 (and hence the housing 462). The main piston 432 extends beyond the first open end 486 of the stopper 472 and into the bore 478 of the housing 462 towards the bore end 482 within the housing 462. There is a main spring 464 (an example of a second biasing means (second biaser), other biasing means (other biasers) may be used), one end of which is connected to the main piston 432, and the other of which is connected to the stopper 472. The main spring 464 biases the main piston 432 out of the bore 484 of the stopper 472 and towards the bore end 482 within the housing 462, i.e. away from the roller 90 of the latching arrangement 40. The main piston 432 is moveable within the bore 484 of the stopper 472 between two positions with respect to the housing 462, over a total stroke A. The sliding movement of the main piston 432 within the bore 484 of the stopper 472 is restricted at one end by contact of the main piston 432 with the bore end 482 of the housing 462, and is restricted at the other end by the bore step 490 of the stopper 472.

The main piston 432 comprises a bore 476 that extends into the main piston 432 from an open end 492 of the main piston 432 to a bore end 494 of the main piston 432. The open end 492 of the bore 476 of the main piston 432 is towards the second open end 488 of the stopper 472. The compliance piston 468 is received in the bore 476 of the main piston 432 for reciprocal sliding movement with respect to the main piston 432. The compliance piston 468 extends beyond the open end 492 of the main piston 432. Moreover, the compliance piston 468 extends through and beyond the second open end 488 of the stopper 472, for engagement with a roller 90 of a latching arrangement 40.

The compliance piston 468 comprises a bore 496 that extends partially into the compliance piston 468 from an open end 402 of the compliance piston 468 to a bore end 498 of the compliance piston 468. The open end 402 of the compliance piston 468 is towards the bore end 494 of the main piston 432.

There is a compliance spring 454(an example of a first biasing means, other biasing means may be used), one end of which is attached to bore end 498 of the compliance piston 468, and the other end of which is connected to the bore end 494 of the main piston 432. The compliance spring 454 biases the compliance piston 468 away from bore end 494 of the main piston 432 and out through the open end 492 of the main piston 432, i.e. towards the roller 90 of the latching arrangement 40.

The main piston 432 comprises a pin 470 that extends radially from a side wall of the main piston 432 partially into the bore 476 of the main piston 432. The compliance piston 468 comprises a slit 404, for example a rounded rectangular slit 404, in the side wall of the compliance piston 468 into which the pin 470 extends. The sliding movement of the compliance piston 468 with respect to the main piston 432 is limited to between two positions, one by contact of the pin 470 with a first end 406 of the slit 404 of the compliance piston, and another by contact of the pin 470 with a second end (not visible in FIG. 7*a*) of the slit 404 of the compliance piston 468. The sliding movement of the compliance piston is therefore limited over a compliance stroke B.

The main piston 432 comprises a second bore 470 partially extending into the main piston 432 from a second open end 410 of the main piston 432 to a second bore end 408 of the main piston 432. The second open end 410 of the second bore 470 has a countersink, and the second bore end 408 is concave in shape with respect to the second open end 482. The second open end 410 of the second bore 470 is on the opposite side of the main piston 432 to the open end 492 of the bore 476 of the main piston 432. There are holes 466*a* and 466*b* on opposite sides of the main piston 432 that extend from the outer surface of the main piston 432 into the second bore 470 of the main piston 432 such that hydraulic fluid may flow from the bore 478 of the housing 462 into the second bore 470 of the main piston 432.

The actuator 94*a* as shown in FIG. 7*a* is in a default retracted "deactuation" state, such that the compliance piston 468 is not touching, and hence not applying any force to, the roller 90 of the latching arrangement 40 (not shown in FIG. 7*a*). The latching arrangement 40 will therefore be in the unlatched position (for example as shown in FIGS. 4*a* and 4*b*).

When actuation of the latching arrangement 40 is required, an oil control valve is operated to increase the oil pressure in an oil gallery. The oil gallery is in fluid connection with the actuator 94*a*. High pressure oil enters the housing 462 through a hole 460*a*/460*b* in the housing wall (an example of a fluid connection), flows through holes 466*a*/466*b* of the main piston 432, and into the second bore 470 of the main piston 432. The high pressure oil flowing into the second bore 470 of the main piston causes the main piston 432 to move outwardly of the housing 462 (i.e. to the left as shown in the figures) through total stroke A. Although reference is made to oil, it will be readily appreciated that any other suitable hydraulic fluid may be used.

As described in more detail below with respect to FIG. 8, the extension of the main piston 432 will either cause an immediate actuation of the latching arrangement 40 to the latched position, or cause a delayed actuation of the latching arrangement 40 to the latched position, depending on the phase of the secondary lift cam 38 when the main piston 432 extends.

Figure 8A:
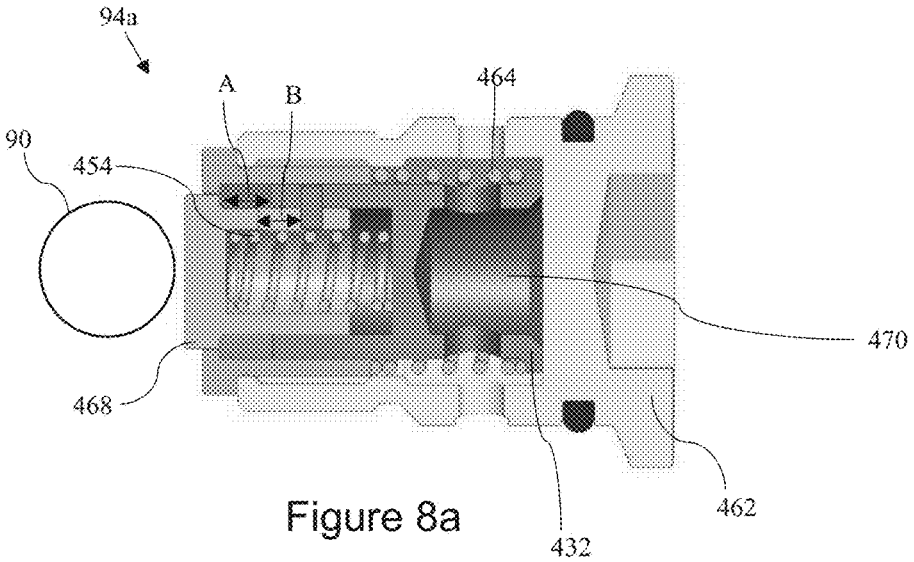
FIGS. 8*a*, 8*b*, and 8*c* schematically illustrate an exemplary actuator in different states of extension.
Figure 8B:
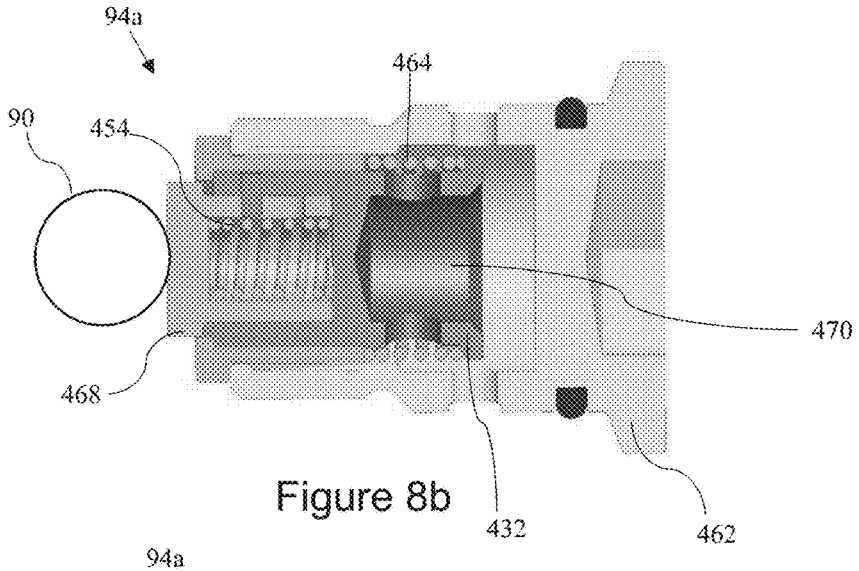
Figure 8C:
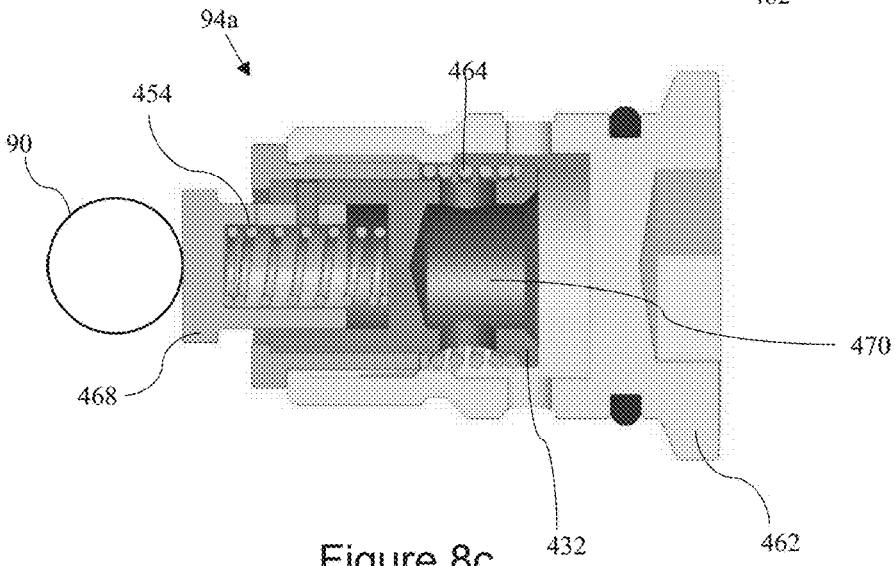

FIGS. 8*a* to 8*c* illustrate schematically the actuator 94*a* in three different states of extension. In these different states, the main piston 432 is in one of a first position and a second position relative to the housing 462, and the compliance piston 468 is in one of a third position and a fourth position relative to the main piston 432. The first position of the main piston 432 relative to the housing 462 is away from the latching arrangement 40 relative to the second position. The third position of the compliance piston 468 relative to the main piston 432 is away from the latching arrangement 40 relative to the fourth position.

In broad overview, FIG. 8*a* corresponds to a fully retracted "deactuation" state, where the main piston 432 is in the first position and the compliance piston 468 is in the fourth position; FIG. 8*b* corresponds to a partially extended "compliance" state, where the main piston 432 is in the second position, and the compliance piston 468 is in the third position; and FIG. 8*c* corresponds to a fully extended "actuation" state, where the main piston 432 is in the second position, and the compliance piston 468 is in the fourth position. The features of the actuator 94*a* shown in FIGS. 8*a* to 8*c* are the same as described with reference to FIG. 7*a*, and will not be described again.

In FIG. 8*a*, the actuator 94*a* is fully retracted, and is in the same state as shown in FIG. 7*a*. This is the default state of the actuator 94*a*. In this state, the compliance piston 468 is not touching, and so is not applying any force to, the roller 90 of the latching arrangement 40 (not shown in FIG. 8). However, it will be appreciated that alternatively in this deactuated state, the compliance piston may be touching, but not applying any significant force to, the roller 90 of the latching arrangement 40 (not shown in FIG. 8). The latching arrangement 40 is in its default, unlatched state.

As described above, when actuation is required, high pressure oil flows into the second bore 470 of the main piston 432, and the main piston 432 moves outwardly of the housing 462 (i.e. to the left in the figures) through total stroke A, that is the main piston 432 moves from the first position to the second position.

In the situation illustrated in FIG. 8*b*, the secondary lift roller 26 is engaging the lift profile 38*a* of the secondary lift cam 38. During the time period where the secondary lift roller 26 is engaging the lift profile 38*a* of the secondary lift cam 38, the rocker arm 2 is in a first configuration in which the inner body 8 is pivoted down from its default position, and hence is obstructing latch pin 80 from moving into the latched position. The latching arrangement 40 is in a non-latchable state. During this time period, therefore, the extension of the main piston 432 from the first position to the second position will not immediately cause the latching pin 80 to move to the latched position, but rather will cause the compliance spring 454 to compress over the compliance stroke B, that is cause the compliance piston 468 to move from the fourth position to the third position.

In the situation illustrated in FIG. 8*c*, the secondary lift roller 26 is now engaging the base circle 38*b* of the secondary lift cam 38. During the time period where the secondary lift roller 26 is engaged with the base circle 38*b* of the secondary lift cam 38, the rocker arm 2 is in a second configuration in which the inner body 8 is in its default upward position (see e.g. FIG. 4*a*) such that it is no longer obstructing latch pin 80 from moving into the latched position. The latch pin 80 may therefore now move freely into the latched position, i.e. the upward facing latch surface 92 of the latch pin 80 may move so as to engage under the inner body 8 (see e.g. FIG. 4*a*). The latch pin assembly is now in a latchable state. The energy stored in the compressed compliance spring 454 as per FIG. 8*b* may now act to move the compliance piston 468 to the left over compliance stroke B, i.e. to move from the third position to the fourth position. As a result, the latching arrangement 40 (via roller 90) is actuated into the latched position.

The compliance piston 468 and compliance spring 454 therefore ensure that regardless of the time the main piston 432 is caused to move from the first position to the second position, the latching arrangement 40 will be actuated into the latched position at the next possible window, i.e. the next time the secondary lift roller 26 is engaging the base circle 38*b* of the secondary lift cam 38. Correct timing of actuation can therefore be easily and consistently achieved.

It will be appreciated that if the secondary lift roller 26 is already engaging the base circle 38*b* of the secondary lift cam 38 when the main piston 432 is moved from the first position to the second position, then the movement of the main piston 432 to the left (in the sense of FIG. 8) will therefore (via compliance spring 454) immediately cause the compliance piston 468 to move to the left, which will in turn immediately cause the roller 90 of the latching arrangement 40, the latching arrangement 40, and the latch pin 8 to move to the left and into the latched position. That is, the actuator will go from the deactuation state of FIG. 8*a* to the actuation state of FIG. 8*c* without entering into the compliance state of FIG. 8*b*.

When deactuation of the latching arrangement 40 is required, the oil control valve is operated to decrease the oil pressure in the oil gallery, which in turn decreases the oil pressure behind and in second bore 470 of the main piston 432. The main piston 432 returns from the second position to the first position (i.e. moves to the right in the figures) under the force of main spring 464. This in turn causes the compliance piston 468 (via compliance spring 454) to move to the right such that no significant force is applied to the roller 90 of the latching arrangement 40. The latch pin 80 therefore returns to the default unlatched position under the force of the spring 85 of the latch assembly.

Figure 9A:
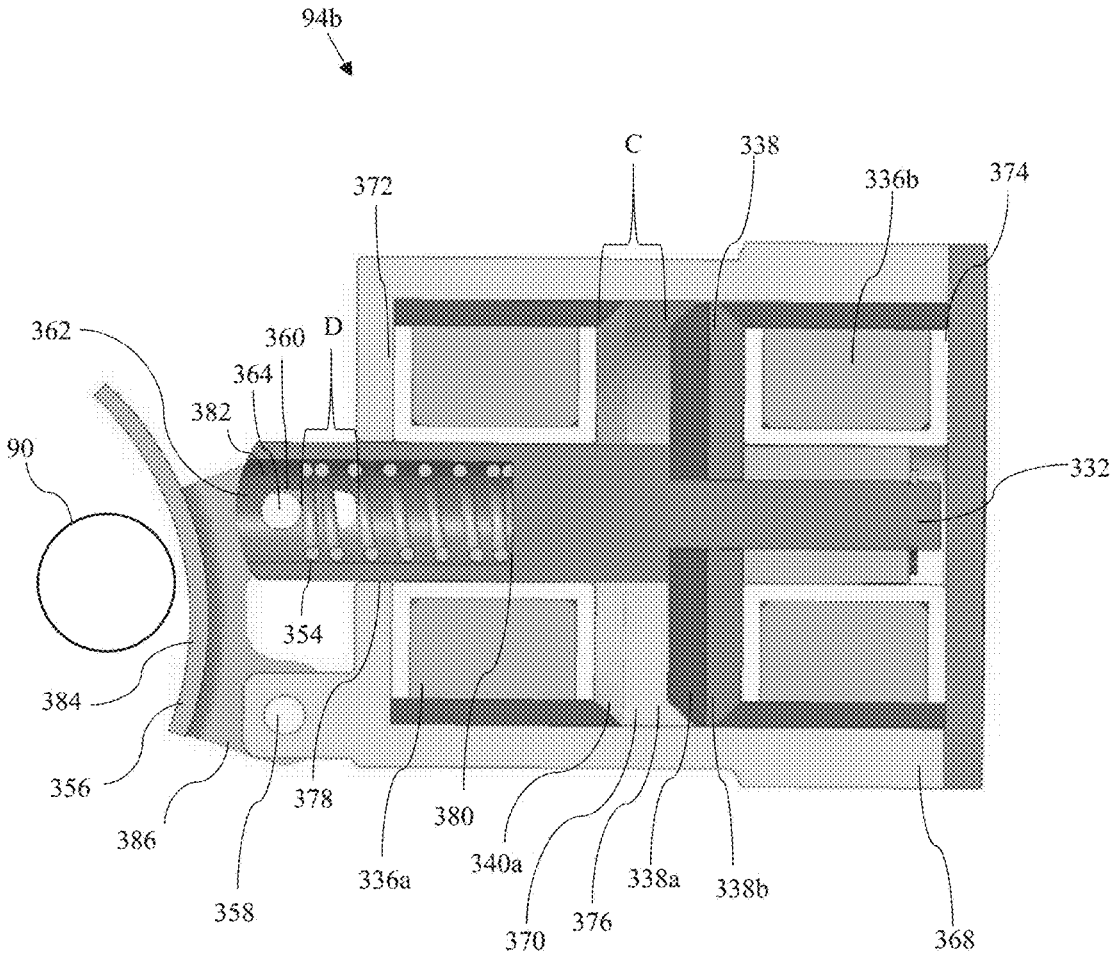
FIG. 9*a* schematically illustrates a cross section and a perspective view of an exemplary actuator.
Figure 9B:
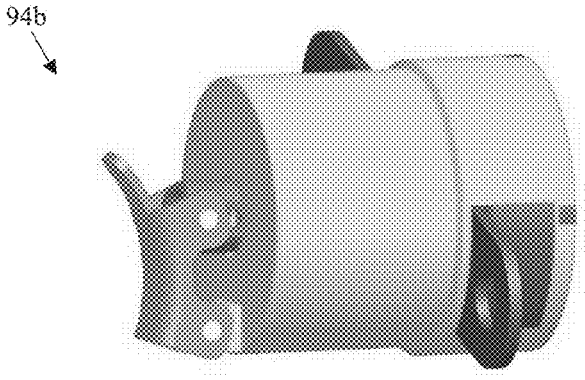
FIG. 9*b* schematically illustrates a perspective view of an exemplary actuator.

FIGS. 9 and 10 illustrate schematically an exemplary electro-magnetic actuator 94*b* for moving the latching arrangement 40 between the un-latched and latched positions. The electro-magnetic actuator 94*b* may be used, for example, as the external actuator 94 described above with reference to FIGS. 4 and 5. FIG. 9*a* illustrates schematically a cross section of the electro-magnetic actuator 94*b*, and FIG. 9*b* illustrates schematically a perspective view of the electro-magnetic actuator 94*b*.

Referring now to FIG. 9*a*, the actuator 94*b* comprises a housing 368 (an example of a first body), a piston 332 (an example of a second body), a contact plate 356 (an example of a third body), solenoids 336*a*, 336*b*, and a permanent magnet 338. The housing 368 and the piston 332 are generally cylindrical in shape, and the solenoids 336*a*, 336*b* are generally annular in shape. The housing 368, piston 332, and solenoids 336*a*, 336*b* share a common principle axis.

At a forward end 372 of the housing 368 there is a hole 378 extending from the outside of the housing 368 to a cylindrical chamber 370 within the housing. The solenoids 336*a*, 336*b* are received in the chamber 370 and are attached to the housing 368. One solenoid 336*a* is located at a forward end 372 of the housing 368, and the other solenoid 336*b* is located at a rear end 374 of the housing 368. The solenoids 336*a*, 336*b* are separated by a gap 376 within the chamber 370. Each solenoid 336*a*, 336*b* has an annular soft iron plate 340*a*, 340*b* respectively, placed against a flat surface of the solenoid 336*a*, 336*b* facing towards the gap 376 (only one soft-iron plate 340*a* is visible in FIG. 9*a*, the other soft-iron plate 340*b* is best seen in FIGS. 10*b* and 10*c*). In the gap 376 between the solenoids 336*a*, 336*b*, there is a permanent magnet 338. One pole (say, South) 338*a* of the permanent magnet 338 faces towards one of the solenoids 336*a*, and the other pole (say, North) 338*b* faces towards the other of the solenoids 336*b*. The magnet 338 is attached to the piston 332.

The piston 332 is received into the hole 378 in the forward end 372 of the housing 368, through the centre of the solenoids 336*a*, 336*b*, and through the annular soft iron plates 340*a*, 340*b*, for reciprocal sliding movement with respect to the housing 368. The piston 332 extends out beyond the hole 378 in the forward end 372 of the housing. The movement of the piston 332 with respect to the housing 368 is restricted to within the total stroke C by the magnet 338 to which the piston 332 is attached coming into contact with the soft iron plates 340*a*, 340*b* of the respective solenoids 336*a*, 336*b* on either side of the magnet 338. The piston 332 is made of a non-magnetic material.

The piston 332 comprises a bore 362 partially extending from an open end 382 of the piston 332 to a bore end 380 within the piston 332. The open end 382 of the piston 332 faces out and away from the housing 368. The piston 332 comprises a rounded rectangular slit 360 in the side of the piston 332 through the wall of the piston 332 into the bore 362. The rounded rectangular slit 360 extends part way along the length of the piston 332 in a portion of the piston 332 extending beyond the hole 378 of the housing 368.

The contact plate 356 comprises a contact portion 384 and a connecting portion 386. A first part 358 of the connecting portion 386 is pivotally connected to the forward end 372 of the housing 368. A second part 364 of the connecting portion 386 is received in the rounded rectangular slit 360 of the piston 332 for reciprocal sliding movement with respect to the piston 332. The movement of the contact plate 356 with respect to the piston 332 is limited to a compliance stroke D between the ends of the rounded rectangular slit 360.

The contact portion 384 of the contact plate 356 is curved such that when the actuator is in a fully extended "actuation" state (see FIG. 10*c* and below) the centre of curvature of the contact portion 384 is in the fulcrum point of the outer arm 10 (not shown in FIG. 9*a*), i.e. within the ball of the lash adjuster 6 that contacts with the outer arm 10. Such curvature of the contact portion 384 allows the actuator 94*b* to provide a constant latching force to the roller 90 of the latching arrangement 40 regardless of the angle that the latch pin 8 makes with respect to the actuator 94*b* during the engine cycle. Moreover, the curvature of the contact portion 384 provides for a reduced sliding force and wear between the roller 90 and the contact portion 384, and provides improved compensation for any tolerances in the rocker arm 2 and the valve train assembly 1, as compared to, for example, a flat contact portion.

The bore 362 of the piston 332 has received therein a compliance spring 354 (an example of a first biasing means, other biasing means can be used), one end of which is connected to (or pushes against) the second part 364 of the connecting portion 386 of the contact plate 356, and the other end of which is connected to (or pushes against) the bore end 380 of the bore 362 of the piston 362. The compliance spring 354 biases the contact plate 356 out and away from the piston 362 and towards the roller 90 of the latching arrangement 40, that is it biases the contact plate 356 anticlockwise in the sense of FIG. 9*a* about the pivotal connection of the first part 358 of the connecting portion 386 to the forward end 372 of the housing 358.

The actuator 94*b* as shown in FIG. 9*a* is in a fully retracted "deactuation" state, such that the contact plate 356 is not touching, and hence not applying any force to, the roller 90 of the latching arrangement 40 (not shown in FIG. 9*a*). The latching arrangement 40 will therefore be in the default unlatched position (for example as shown in FIGS. 4*a* and 4*b*).

When actuation is required, an electronic controller causes current to pass through the solenoids 336*a*, 336*b*. The current is controlled to flow in the same direction in both of the solenoids 336*a*, 336*b*, say clockwise when viewed from the forward end 372 of the housing 368. Such a current flowing in the solenoid 336*a* at the forward end 372 of the housing 368 will cause the soft iron plate 340*a* attached thereto to become magnetised so as to attract the South side 338*a* of the permanent magnet 338. Conversely, such a current flowing in the solenoid 336*b* at the rear end 374 of the housing 368 will cause the soft iron plate 340*b* (best seen in FIGS. 10*b* and 10*c*) attached thereto to become magnetised so as to repel the North side 338*b* of the permanent magnet 338. The net result will therefore be that the magnet 338, and hence the piston 332, will move to the left in the sense of FIG. 9*a* over total stroke C. The current flowing in the solenoids 366*a*, 366*b* may now be stopped, but the magnet 338 and hence piston 332, will not move from its present left hand position, because the soft iron plates 340*a*, 340*b* remain magnetised.

Similarly to as above for hydraulic actuator 94*a*, and as described in more detail below with respect to FIG. 10, the extension of the piston 332 will either cause an immediate actuation of the latching arrangement 40 to the latched position, or cause a delayed actuation of the latching arrangement 40 to the latched position, depending on the phase of the secondary lift cam 38 when the piston 432 extends.

Figure 10A:
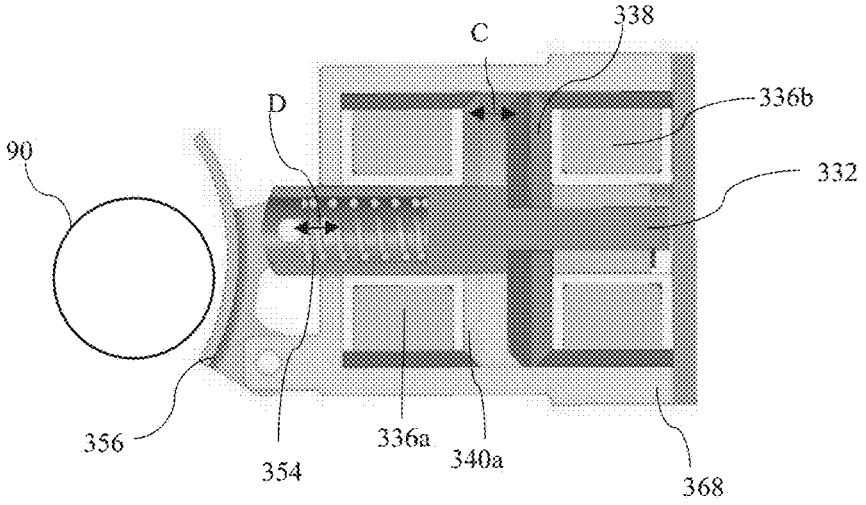
FIGS. 10*a*, 10*b*, and 10*c* schematically illustrate an exemplary actuator in different states of extension.
Figure 10B:
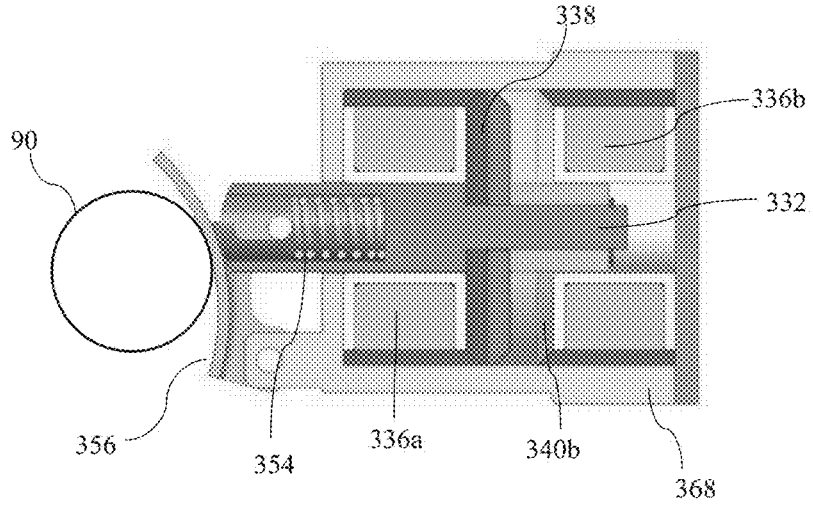
Figure 10C:
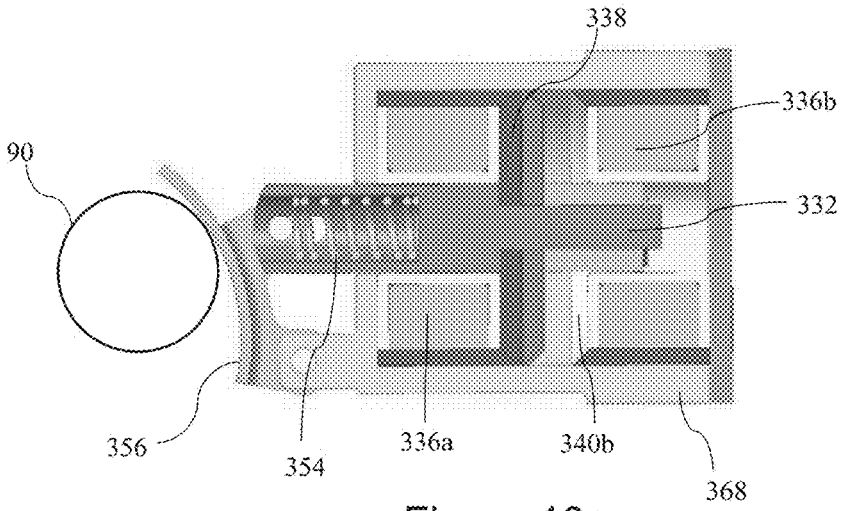

FIGS. 10*a* to 10*c* illustrate schematically the electromagnetic actuator 94*b* in three different states of extension. In these different states, the piston 332 is in one of a first position and a second position relative to the housing 362, and the contact plate 368 is in one of a third position and a fourth position relative to the piston 332. The first position of the piston 332 relative to the housing 362 is away from the latching arrangement 40 relative to the first position. The third position of the contact plate 368 relative to the piston 332 is away from the latching arrangement 40 relative to the fourth position. In broad overview: FIG. 10*a* corresponds to a fully retracted "deactuation" state, where the piston 332 is in the first position, and the contact plate 356 is in the fourth position; FIG. 10*b* corresponds to a partially extended "compliance" state, where the piston 332 is in the second position, and the contact plate 356 is in the third position; and FIG. 10*c* corresponds to a fully extended "actuation" state, where the piston 332 is in the second position, and the contact plate 356 is in the fourth position. The features of the actuator 94*b* shown in FIGS. 10*a* to 10*c* are the same as described with reference to FIG. 9, and will not be described again.

In FIG. 10*a*, the actuator 94*b* is fully retracted, and is in the same state as shown in FIG. 9*a*. In this state, the contact plate 356 is not touching, and so is not applying any force to, the roller 90 of the latching arrangement 40 (not shown in FIG. 10). It will be appreciated that alternatively, the contact plate 356 can be touching, but not applying any significant force to, the roller 90 of the latching arrangement 40 in this deactuation state. The latching arrangement 40 is in its default, unlatched state.

As described above, when actuation is required, a current is provided through the solenoids 336*a*, 336*b*, and the magnet 338 and hence piston 332 moves outwardly of the housing 462 (i.e. to the left in the figures) through total stroke C, that is the piston 332 moves from the first position to the second position.

In the situation illustrated in FIG. 10*b*, the secondary lift roller 26 is engaging the lift profile 38*a* of the secondary lift cam 38. During this time, the inner body 8 is pivoted down from its default position, and hence is blocking latch pin 80 from moving into the latched position. During this time, therefore, the movement of the piston 332 from the first position to the second position will not immediately cause the latching pin 80 to move to the latched position, but rather will cause the compliance spring 354 to compress over the compliance stroke D, that is to move the contact plate 356 from the fourth position to the third position.

In the situation illustrated in FIG. 10*c*, the secondary lift roller 26 is now engaging the base circle 38*b* of the secondary lift cam 38. The inner body 8 is now in its default upward position (see e.g. FIG. 4*a*), and hence the latch pin 80 may now move freely into the latched position, i.e. the upward facing latch surface 92 of the latch pin 80 may move so as to engage under the inner body 8 (see e.g. FIG. 4*a*). The energy stored in the compressed compliance spring 354 as per FIG. 10*b* may now act to move the contact plate 356 to over compliance stroke B from the third position to the fourth position, i.e. to rotate contact plate 356 anticlockwise about the pivotal connection 358 of the contact plate 356 to the housing 368, and hence move the latch pin arrangement 40 (via roller 90) into the latched position.

The compliance spring 354 therefore ensures that regardless of the time the piston 332 is controlled to move to from the first position to the second position, the latching arrangement 40 will be actuated into the latched position at the next possible window, i.e. the next possible time the secondary lift roller 26 is engaging the base circle 38*b* of the secondary lift cam 38. Correct timing of actuation can therefore be easily and consistently achieved.

It will be appreciated that if the secondary lift roller 26 is already engaging the base circle 38*b* of the secondary lift cam 38 when the piston 332 is moved from the first position to the second position, then the movement of the piston 332 to the left will therefore (via compliance spring 354) immediately cause the contact plate 356 to move to the left, which will in turn immediately cause the roller 90 of the latching arrangement 40, the latching arrangement 40, and the latch pin 80 to move to the left and into the latched position. That is, the actuator 94*b* will go from the deactuation state of FIG. 10*a* to the actuation state of FIG. 10*c* without entering into the compliance state of FIG. 10*b*.

When deactuation of the latching arrangement 40 is required, electronic controller is operated to cause current to flow through the solenoids 366*a*, 366*b* in the opposite sense to as during actuation, i.e. anticlockwise when viewed from the contact plate 356. The magnet 338 is therefore caused to move to the right under the respective attraction and repulsion of the soft iron plates of solenoids 336*b*, 336*a*. The piston 332 therefore correspondingly moves to the right in the figures from the second position to the first position. This in turn causes the contact plate 356 (via compliance spring 354) to move to the right such that no significant force is applied to the roller 90 of the latching arrangement 40. The latch pin 80 therefore returns to the default unlatched position under the force of the spring 85 of the latching arrangement 40.

It will be appreciated that although the surface of the compliance piston 468 of actuator 94*a* is flat, this need not necessarily be the case, and a curved contact plate such as contact plate 356 of actuator 94*b* may be used instead.

It will be appreciated that although in the above example, two solenoids 336, two soft-iron plates 340*a*, 340*b*, and one permanent magnet 338 was used, this need not necessarily be the case, and in some examples actuator 94*b* may comprise one or more solenoids, one or more soft iron-plates 340*a*, 340*b*, and one or more permanent magnets 338.

It will be appreciated that the soft-iron plates 340*a*, 340*b* may instead be made of any suitable magnetisable material.

The above description included an example of an actuator 94, 94*a*, 94*b* actuating a latching arrangement 40 in a rocker arm 2 comprising a plurality of bodies that move relative to one another, and which are latched together to provide one mode of operation (valve-lift mode) and are unlatched, and hence can move with respect to each other, to provide a second mode of operation (valve-lift mode). However, it will be appreciated that the actuator 94, 94*a*, 94*b* is not limited to use in this example, or to use with a dual-body rocker arm. It will be appreciated that the actuator 94*a*, 94*b* may be used to actuate valve-lift modes in any valve train assembly capable of being switched between a first valve-lift mode and a second valve-lift mode, for example, valve train assemblies for Variable Valve Actuation in Medium and/or Heavy Duty Engines known in the art.

Figure 11:
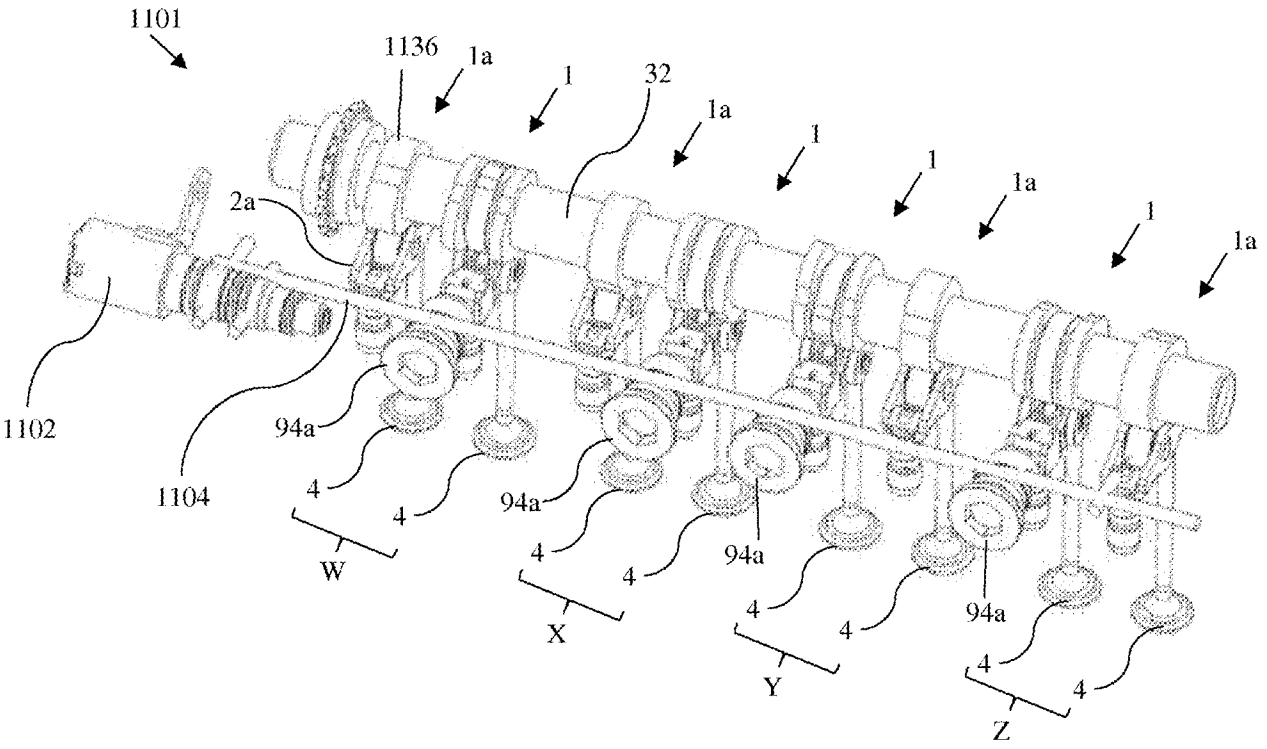
FIG. 11 schematically illustrates a perspective view of an exemplary exhaust valve train assembly.

FIG. 11 illustrates a portion of an exhaust valve train assembly 1101 of a four cylinder internal combustion engine. The exhaust valve train assembly 1101 comprises a main cam shaft 32 held in a cam carrier. The cam shaft 32 drives the opening of in total eight exhaust valves 4. There are four groups W, X, Y, Z of two exhaust valves 4 each, one group per cylinder. One exhaust valve 4 per group is of the valve train assembly 1 as described above with reference to FIGS. 1 to 6, the latch pin 80 (not visible in FIG. 11) of which being actuated using the hydraulic actuator 94*a* as described above with reference to FIGS. 7*a* to 8*c*. This valve train assembly 1 per group W, X, Y, Z provides internal Exhaust Gas Recirculation on demand as described above. The other exhaust valve 4 per group is driven by a valve train assembly 1*a* similar to that as described above with reference to FIGS. 1 to 6, except that the valve train assembly 1*a* comprises a standard, single lift, i.e. non-switchable, rocker arm 2*a* driven in a fashion as is known per say by a single main lift cam 1136 of the cam shaft 32. This standard valve train assembly 1*a* per group W, X, Y, Z provides standard exhaust valve opening as is known per say.

The four groups W, X, Y, Z extend side by side along the length of the cam shaft 32. The main lift cam 1136 of the standard valve train assembly 1*a* is in phase with the main lift cams 34, 36 of the valve train assembly 1, per group. The secondary lift cam 38 of the valve train assembly 1 is out of phase with the main lift cams 34, 36 of the valve train assembly 1 as described above, per group. The main lift cams 1136, 34, 38 of any one group W, X, Y, Z are out of phase with respect to the main lift cams 1136, 34, 38 of any one other group to allow for exhaust gas release from the correspondingly out of phase combustion in each cylinder.

Each hydraulic actuator 94*a* of each "dual lift" valve train assembly 1 of each group W, X, Y, Z is in fluid communication with a common oil gallery 1104. The common oil or supply gallery 1104 is connected to each of the hydraulic actuators 94*a* and is for supplying pressurised oil to the hydraulic actuators 94*a*. Specifically, the common oil gallery 1104 is in fluid communication with the second bore 470 of each actuator 94*a* via one of the holes 460*a*/460*b* in the housing wall of each actuator 94*a*. In the example illustrated, the other of the holes 460*a*/460*b* is closed off. In other examples, the common oil gallery 1104 may run through each actuator 94*a* from one hole 460*a*/460*b* to the other hole 460*a*/460*b*. The common oil gallery 1104 may be defined in the cam carrier. This may save space.

Oil (or any hydraulic fluid) is supplied to the common oil gallery 1104 by an oil control valve (OCV) 1102. The oil control valve is controllable (for example by electrical signal) to increase or decrease the pressure of the oil in the common oil gallery 1104. When the OCV 1102 is controlled to deliver high pressure oil (for example when actuation of the latching arrangement is required, for example when an iEGR active mode is required in the engine), the pressure in the common oil gallery 1104 increases, and hence high pressure oil enters the housing 462 of each hydraulic actuator 94*a* of each group W, X, Y, Z, which (as described above) causes the main piston 432 of each hydraulic actuator 94*a* to move outwardly of the housing 462 through the total stroke A (as described above with reference to FIGS. 7*a* to 8*c*). The oil control valve 1102 may be incorporated into the cam carrier.

As described above, depending on the phase of the secondary lift cam 38 of the valve train assembly 1 to which the actuator 94*a* corresponds when the main piston 432 extends, the extension of the main piston 432 will either cause an immediate actuation of the latching arrangement 40 to the latched position, or cause a delayed actuation of the latching arrangement 40 to the latched position. However, within (at most) one full rotation of the cam shaft 32, the secondary lift roller 26 of each valve train assembly 1 will have engaged the corresponding base circle 38*b* of the secondary lift cam 38 of each valve train assembly, and hence within (at most) one full rotation of the cam shaft 32, the extension of the main piston 432 of each actuator 94*a* will have caused actuation of the latching arrangement 40 of each respective valve train assembly 1 to the latched position.

When actuation of the latching arrangement 40 of each valve train assembly 1 is no longer required, the oil control valve 1102 may be controlled to reduce the oil pressure in the common oil gallery 1104, and hence the main piston 432 of each hydraulic actuator 94*a* may return to the default de-actuated position under the force of the return spring 464 as described above with reference to FIGS. 7*a* to 8*c*.

Controlled actuation of the latching arrangement 40 of each valve train assembly 1 (within (at most) one revolution of the cam shaft 32) is thereby achieved by controlling a single oil control valve 1102 in fluid communication with each of the actuators 94*a* via the common oil gallery 1104. This may reduce complexity and cost, and provide space savings, as compared for example to controlling the actuation of each latching arrangement 40 separately.

Similarly to as mentioned above, in an alternative arrangement the valves 4 are instead intake valves rather than an exhaust valves (making the rocker arms 2 of the valve train assemblies 1 an intake rocker arm) and an exhaust rocker arm operates an exhaust valve in response to an exhaust cam mounted on the cam shaft. In this alternative arrangement the cams are arranged so that in any given engine cycle, the additional smaller opening of the intake valve occurs when the exhaust valve is open to thereby provide a degree of internal exhaust gas recirculation.

Although some of the above examples referred to actuation of the latching arrangement 40 causing an internal Exhaust Gas Recirculation active mode of the associated valve train assembly 1, this need not necessarily be the case. The actuation may be of the respective latching arrangements of any a plurality of rocker arms each for operating a respective engine valve, each rocker arm comprising a first body, a second body and a latch pin that is moveable between a first position in which the latch pin latches the first body and the second body together and a second position in which the first body and the second body are un-latched to allow pivotal motion of the second body relative to the first body. For example, one or more of the valve train assemblies 1 may be configured for Early Exhaust Valve Opening (EEVO), and hence actuation of the latching arrangement 40 may cause an EEVO active mode of the associated valve train assembly 1.

Although the above example described hydraulic actuation of the latching arrangements 80 of the respective valve train assemblies 1 using the hydraulic actuator described above with reference to FIGS. 7*a* to 8*c*, this need not necessarily be the case, and in other examples the assembly 1101 may comprise a respective hydraulic actuator of any type for each latch pin 80, and any common supply gallery 1104 connected to each of the hydraulic actuators for supplying pressurised oil to the hydraulic actuators.

In embodiments, an actuator for actuating valve-lift modes of a valve train assembly of an internal combustion engine is provided. The valve train assembly is capable of being switched between a first valve-lift mode and a second valve-lift mode. The actuator comprises a first body. A second body is mounted for reciprocal movement with respect to the first body between a first position to cause the first valve-lift mode and a second position to cause the second valve-lift mode. A third body is supported by the second body, the third body being for moving a first component of the valve train assembly to cause the second valve-lift mode. The third body is moveable relative to the second body. A first biaser (biasing means) biases the third body away from the second body towards the first component of the valve train assembly. Also presented is a valve train assembly.

All of the above embodiments are to be understood as illustrative examples of the invention only. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An actuator for actuating valve-lift modes of a valve train assembly of an internal combustion engine, the valve train assembly being switched, when the valve train assembly is in use, between a first valve-lift mode and a second valve-lift mode, the actuator comprising:

a first body;

a second body mounted for reciprocal movement with respect to the first body between a first position to cause the first valve-lift mode and a second position to cause the second valve-lift mode via hydraulic or electromagnetic actuation; and a third body supported by the second body, a first component of the valve train assembly being moved by the third body when the actuator is in use to cause the second valve-lift mode, wherein the third body is moved relative to the second body when the actuator is in use; and a first spring which biases the third body away from the second body towards the first component of the valve train assembly.

2. The actuator according to claim 1, wherein the actuator is configured such that in use, the first position is away from the first component of the valve train assembly relative to the second position.

3. The actuator according to claim 1, wherein the third body is moved when the actuator is in use between a third position and a fourth position relative to the second body, and, the actuator is configured such that in use, the third position is away from the first component of the valve train assembly relative to the fourth position and the first spring biases the third body to the fourth position.

4. The actuator according to claim 3, wherein the actuator is configured such that in use, when the second body moves from the first position to the second position during a first time period, the second valve-lift mode is actuated immediately; and when the second body moves from the first position to the second position during a second time period, second valve-lift mode is not actuated immediately.

5. The actuator according to claim 4, wherein the actuator is configured such that in use, when the second body moves from the first position to the second position during the second time period, the third body moves from the fourth position to the third position and the first spring is compressed.

6. The actuator according to claim 4, wherein when the second body moves from the first position to the second position during the second time period, the second valve-lift mode is actuated at a next occurrence of the first time period.

7. The actuator according to claim 4, wherein the first time period is a first engine cycle period in which the valve train assembly is in a first configuration in which actuation of the second valve-lift mode is possible, and the second time period is a second engine cycle period in which the valve train assembly is in a second, different configuration in which actuation of the second valve-lift mode is not possible.

8. The actuator according to claim 7, wherein in the first configuration, a second component of the valve train assembly is positioned to obstruct actuation of the second valve-lift mode, and, in the second configuration, the second component of the valve train assembly is positioned such that the second component does not obstruct actuation of the second valve-lift mode.

9. The actuator according to claim 1, wherein the second body is controlled when the actuator is in use to move between the first position and the second position with respect to the first body by hydraulic actuation.

10. The actuator according to claim 9, wherein the actuator comprises a second spring which biases the second body to the first position.

11. The actuator according to claim 9, wherein the second body is received in the first body, and the third body is received in the second body.

12. The actuator according to claim 9, wherein the first body comprises a fluid connector for receiving hydraulic fluid from a hydraulic fluid control valve in use, and wherein the actuator is configured such that:

when a first hydraulic fluid is sent to the fluid connector by the hydraulic fluid control valve in use, the second body is caused to move from the first position to the second position; and when a second hydraulic fluid having a lower pressure than the first hydraulic fluid is sent to the fluid connector by the hydraulic fluid control valve in use, the second body is caused to move from the second position to the first position.

13. The actuator according to claim 1, wherein the second body is controlled when the actuator is in use to move between the first position and the second position with respect to the first body by electromagnetic actuation.

14. The actuator according to claim 13, wherein the actuator comprises:

one or more solenoids;

one or more magnet portions which are magnetised during use of the actuator; and one or more permanent magnet elements mechanically coupled to the second body;

wherein the actuator is arranged such that control of a current flowing in the one or more solenoids causes magnetisation of the one or more magnet portions, thereby to attract or repel the one or more permanent magnet elements, and thereby to cause the second body to switch from the first position to the second position or from the second position to the first position.

15. The actuator according to claim 1, wherein the valve train assembly comprises a dual-body rocker arm, wherein the first component of the valve train assembly is a latching arrangement of the dual-body rocker arm which, when the actuator is in use, latches a first rocker arm body of the dual-body rocker arm to a second rocker arm body of the dual-body rocker arm, and wherein:

the first and second rocker-arm bodies are latched to provide the first valve-lift mode, and the first and second rocker-arm bodies are unlatched to provide the second valve-lift mode, or the first and second rocker-arm bodies are latched to provide the second valve-lift mode, and the first and second rocker-arm bodies are unlatched to provide the first valve-lift mode.

16. The actuator according to claim 15, wherein the third body is moved when the actuator is in use between a third position and a fourth position relative to the second body, and wherein the third body comprises a first member for contacting the latching arrangement, and wherein the first member is curved such that when the second body is in the second position, and the third body is in the fourth position, a centre of curvature of the first member is at a fulcrum of the dual-body rocker arm in use.

17. The actuator according to claim 16, wherein the third body is pivotally mounted at a first pivot point, such that the third body when in the fourth position is rotated with respect to the third position about the first pivot point.

18. A valve train assembly of an internal combustion engine, the valve train assembly being switched when the valve train assembly is in use between a first valve-lift mode and a second valve-lift mode, the valve train assembly comprising:

the actuator according to claim 1.

19. The valve train assembly according to claim 18, wherein one of the first valve-lift mode and the second valve-lift mode is an Internal Exhaust Gas Recirculation valve-lift mode.

20. A valve train assembly of an internal combustion engine comprising:

a dual-body rocker arm comprising a latching arrangement which latches bodies of the dual-body rocker arm when the valve train assembly is in use; and the actuator according to claim 7;

wherein, the dual-body rocker arm comprises:

a first rocker arm body; and a second rocker arm body pivotally mounted with respect to the first rocker arm body;

the second rocker arm body supporting a first axle on which a first roller is mounted, the first roller being for engaging a first rotatable cam surface when the valve train assembly is in use, whereby the second rocker arm body is pivoted with respect to the first rocker arm body by the first rotatable cam surface;

wherein the first engine cycle period comprises a period wherein the first roller is engaging a base circle of the first rotatable cam surface; and wherein the second engine cycle period comprises a period wherein the first roller is engaging a lobe of the of the first rotatable cam surface.

21. An assembly for an internal combustion engine, the assembly comprising:

a plurality of rocker arms each for operating a respective engine valve, each rocker arm comprising a first body, a second body and a latch pin that is moved when the internal combustion engine is in operation between a first position in which the latch pin latches the first body and the second body together and a second position in which the first body and the second body are un-latched to allow pivotal motion of the second body relative to the first body;

a respective hydraulic actuator for each latch pin, each of the hydraulic actuators comprising:

a first body;

a second body mounted for reciprocal movement with respect to the first body between a first position to cause a first valve-lift mode and a second position to cause a second valve-lift mode via hydraulic actuation; and a third body supported by the second body, a first component of the valve train assembly being moved by the third body when the actuator is in use to cause the second valve-lift mode, wherein the third body is moved relative to the second body when the actuator is in use; and a first spring which biases the third body away from the second body towards the first component of the valve train assembly; and a common supply gallery connected to each of the hydraulic actuators for supplying pressurised hydraulic fluid to the hydraulic actuators.

22. The assembly of claim 21 wherein the supply gallery comprises a section that extends substantially in a straight line transversely to the hydraulic actuators.

23. The assembly of claim 22 wherein the supply gallery is defined in a cam carrier.

24. The assembly of claim 21 comprising a hydraulic fluid control valve for controlling the supply of pressurised hydraulic fluid to the supply gallery.

25. The assembly of claim 24 wherein the hydraulic fluid control valve is incorporated in a cam carrier.

26. The assembly of claim 21 wherein, when the latch pin of each rocker arm is in the first position each rocker arm is in an internal Exhaust Gas Recirculation iEGR active mode or an Early Exhaust Valve Opening (EEVO) active mode.

27. The assembly of claim 21 wherein the hydraulic fluid is oil.

* * * * *